US007059383B1

(12) United States Patent
Tremblay et al.

(10) Patent No.: US 7,059,383 B1
(45) Date of Patent: Jun. 13, 2006

(54) MOLTEN METAL HANDLING APPARATUS

(76) Inventors: Sylvain P. Tremblay, 193 Terasse du Ford, Chicoutimi, Quebec (CA) G7G5C8; Mark Brian Vincent, 19 Hydrus Drive, Leighton Buzzard, Bedfordshire (GB) LU7 3UL ( * ) Notice: Subject to any disclaimer, the term of this patent is extended or adjusted under 35 U.S.C. 154(b) by 0 days.

(21) Appl. No.: 11/044,890

(22) Filed: Jan. 27, 2005

(51) Int. Cl.
*B22D 11/124* (2006.01)

(52) U.S. Cl. ..... 164/439; 164/437

(58) Field of Classification Search ..... 164/439, 164/437, 487, 488
See application file for complete search history.

(56) References Cited

U.S. PATENT DOCUMENTS 3,739,837 A * 6/1973 Wagstaff et al. ..... 164/444
4,372,544 A * 2/1983 LaBate ..... 266/281
4,597,432 A * 7/1986 Collins et al. ..... 164/444
4,678,719 A * 7/1987 Johns et al. ..... 428/593
4,802,436 A * 2/1989 Wilson et al. ..... 164/440
4,986,337 A * 1/1991 Soulier ..... 164/420
5,204,298 A * 4/1993 Yaoi et al. ..... 501/108
5,318,098 A * 6/1994 Wagstaff et al. ..... 164/444
5,323,841 A * 6/1994 Wagstaff et al. ..... 164/444
6,848,497 B1 2/2005 Sale et al.

* cited by examiner

*Primary Examiner*—Len Tran

(57) ABSTRACT

An integral molten metal casting device comprising: a crossfeeder having an interior surface defining a partial cylinder of a first diameter; a generally cylindrical thimble having an interior surface of a second smaller diameter; and back-up insulation; all formed as a single monolithic structure with the crossfeeder interior surface and the thimble interior surface comprising a continuous, joint free and uninterrupted cylinder insert surface of a thin layer or multiple layers of fiber reinforced low thermal expansion coefficient, high wear resistant material. According to certain preferred embodiments, the thin layer or layers comprise fused silica, alumina or zirconia, and mixtures of these materials with other similar materials such as silicon carbide. Monolithic integrally formed molten metal handling systems of similar structure are also described.

14 Claims, 5 Drawing Sheets

MOLTEN METAL HANDLING APPARATUS

FIELD OF THE INVENTION

The present invention relates to apparatus useful in the casting of molten metal and more particularly to such devices as are useful in the casting of so-called "logs", "billet" or "round ingots" from, for example aluminum.

BACKGROUND OF THE INVENTION

In the casting of molten metals such as aluminum, apparatus and processes have been developed for the simultaneous casting of a plurality of logs, billets or round ingots, hereinafter logs, so as to increase the efficiency and productivity of the casting process. In such processes and apparatus, a casting table having a plurality of apertures or molds is mounted over a pit from which emerge an equally numbered plurality of hydraulically operated bottom blocks. Each of the bottom blocks is registered, i.e. aligned with, one of the molds or apertures. The casting table includes trough or distribution channels for the dissemination of molten metal introduced into thereto to each of the individual molds or apertures located in the casting table. As metal from the distribution channels or troughs in the casting table enters the individual molds, the plurality of bottom blocks is lowered in unison to allow for removal of metal that has solidified in the mold therefrom and to provide space for the introduction of additional incoming molten metal. Water is sprayed at carefully selected points below the molds or apertures to assist in the solidification of the molten metal passing through the mold or aperture. Such a prior art casting table is shown in FIG. 1 and described in greater detail hereinafter.

While the metal distribution of the casting tables of the prior art as depicted in FIG. 1 have proven highly useful and reliable over many years of service in a multitude of installations, they suffer a number of shortcomings.

As those skilled in the metal casting arts are well aware, it is critically important that molten metal reach each of the molds or apertures at substantially the same time with minimal temperature loss to obtain a successful cast of the plurality of logs being simultaneously cast. If metal reaching one or more apertures is too hot or hold time is too short and does not solidify as the bottom clock or base plate descends, a "bleedout" can result. In such a condition, molten metal can be brought into contact with water applied as a spray in the process of cooling the solidifying metal. Such a condition requires rapid plugging of the aperture or mold that is experiencing the "bleedout" with the result that that portion of the production is lost for the cast. Alternatively, if metal has resided in the mold for too long a period of time, it may be cooler that the balance of the molten metal and therefor solidify more quickly in the cooler mold than metal entering other molds in the casting table resulting in a "freeze-in", i.e. the solidified metal becomes caught in the mold. A freeze-in can drop out during casting and also result in a bleedout. Such a condition can result in the aborting of the cast entirely and necessitate a free up of the metal caught in the mold and a restart of the cast. Such errors cause significant productivity losses and, more importantly, place operators in significant danger from a safety standpoint. If metal enters the mold with too much velocity or too hot, penetrates between the mold and the soldified head of the forming log "flashing" may occur. Flashing is another condition that may result in molten metal coming into contact with cooling water applied to the log below the solidification point.

Flashing also causes damage to molds or distortion or delays in the bottom block movement that can also result in casting defects, bleedouts or complete table freeze-in that requires abortion of the cast and an extensive and time consuming clean up.

Finally, the mold portions of the prior art casting tables comprise multi-part elements that require assembly in the casting table costing valuable assembly or set-up time and which because of their design leave exposed joints between the individual elements of the assembly that are sometimes prone to leaking, particularly if not carefully and properly assembled.

From the foregoing and as well known to those skilled in the molten metal casting arts, control of the temperature of the molten metal from the time that it enters the molten metal distribution system until it pass through one of the molds is critically important to the successful practice of molten metal casting. Hence, minimization of heat loss throughout the process is a primary concern along with ease of set-up.

U.S. Pat. No. 6,848,497 issued Feb. 1, 2005 copending and of common ownership herewith, describes an integral molten metal casting insert comprising a generally cylindrical crossfeeder having and interior surface, a cylindrical thimble having and interior surface of a second diameter and integral back-up insulation all formed as a monolithic structure with the cross feeder interior surface and the thimble interior surface comprising a joint free and uninterrupted cylindrical insert surface peripherally surrounded by the back-up insulation. This patent is incorporated wherein in its entirety for purposes of its disclosure. In this patent, the cross feeder and thimble interior surfaces preferably comprise a low density refractory material and the back-up insulation comprises a castable refractory. More specifically, the low density refractory comprises a fiber glass fabric impregnated with a wollastonite slurry while the castable insulating refractory preferably comprises a phosphate bonded mineral foam composed primarily of calcium silicate. While such a device provides excellent results in terms of solving the potential molten metal leakage problems addressed in that application, as well as the conservation of heat and thus maintenance of temperature referred to herein, it has now been found that difficulty in manufacturing as well as insert life posed previously unforeseen problems. Thus a need has arisen to find a more manufacturable and durable casting insert structure that provides the excellent temperature retention properties of the structure disclosed in the '497 patent while simultaneously avoiding the potential leakage problems of the prior art structures. Similar heat conservation, durability and maintenance issues exist with virtually any molten metal handling system such as transfer troughs etc.

OBJECTS OF THE INVENTION

It is therefore an object of the present invention to provide a casting mold/molten metal handling structure that simplifies mold installation and changeout while minimizing heat loss in the mold.

It is another object of the present invention to provide a more durable casting mold/molten metal handling structure than that described in the parent '119 application.

SUMMARY OF THE INVENTION

According to the present invention, there is provided an integral molten metal casting device comprising: a crossfeeder having an interior surface defining a partial cylinder of a first diameter; a generally cylindrical thimble having an interior surface of a second smaller diameter; and back-up insulation; all formed as a single monolithic structure with the crossfeeder interior surface and the thimble interior surface comprising a continuous, joint free and uninterrupted cylinder insert surface of a thin layer or multiple layers of fiber reinforced low thermal expansion coefficient, high wear resistant and high density refractory material. According to certain preferred embodiments, the thin layer or layers comprise fused silica, alumina or zirconia, and mixtures of these materials with other similar high density refractory materials such as silicon carbide. Monolithic integrally formed molten metal handling systems of similar structure are also described.

DETAILED DESCRIPTION

Figure 1:
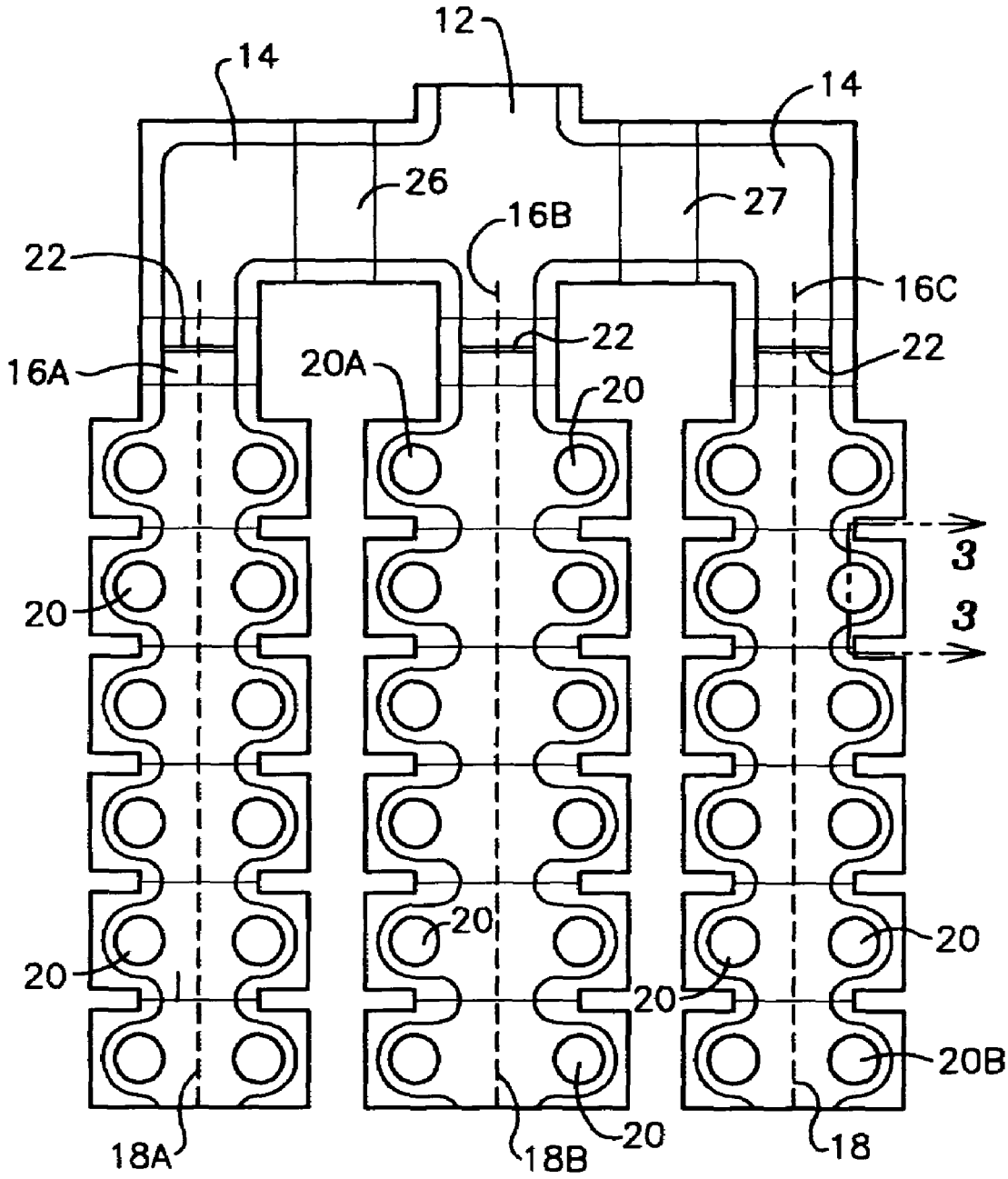
FIG. 1 PRIOR ART
FIG. 1 is a top plan view of a metal distribution system of the prior art.

Referring now to FIG. 1 for additional background on the casting structures and devices of the prior art and their relation to the devices disclosed and claimed herein, in the prior art a metal distribution system 10 for the simultaneous production of multiple logs or round billets comprised an inlet 12 feeding a primary trough 14 that in turn fed secondary troughs 16*a*, 16*b* and 16*c*. Located at approximately right angles to the major (long) axes 18*a*, 18*b* and 18*c* of secondary troughs 16*a*, 16*b* and 16*c* and on opposing sides thereof are pairs of opposed round apertures 20 (only some being specifically identified in FIG. 1 for clarity) each of apertures 20 containing a mold as will be described below in connection with FIG. 3. Insertion of manual dams 22 requires manual removal to begin the flow of metal into troughs 16*a*, 16*b* and 16*c*. In the casting operation, molten metal was provided to primary trough 14, passed therethrough to secondary troughs 16*a*, 16*b* and 16*c* and thence into apertures 20. While, as previously mentioned such a structure has provided a highly useful arrangement, it did demonstrate several shortcomings. Among these were that all of the apertures 20 did not fill at the same time, thus resulting in temperature and solidification differences inside the sump between the first and last to fill with entering molten metal, for example, the aperture designated 20*a* and that designated 20*b* in FIG. 1. Such a condition can and often did lead to the problems previously referred to as "bleedout" or "freeze-in". Additionally, the casting practice commonly used with a metal distribution system of this type called for starting the flow of molten metal through inlet 12 and then sequentially and manually removing dams 22. The need to manually operate the damming arrangement required the presence of operators, most generally 2 on the surface of the casting table 10 to perform removal of the dams. This posed a significant safety hazard as the presence of personnel in the immediate area of the casting table is always a cause for safety concerns. Thus, the design and availability of a casting table that eliminated such issues had been long sought after objectives.

Figure 2:
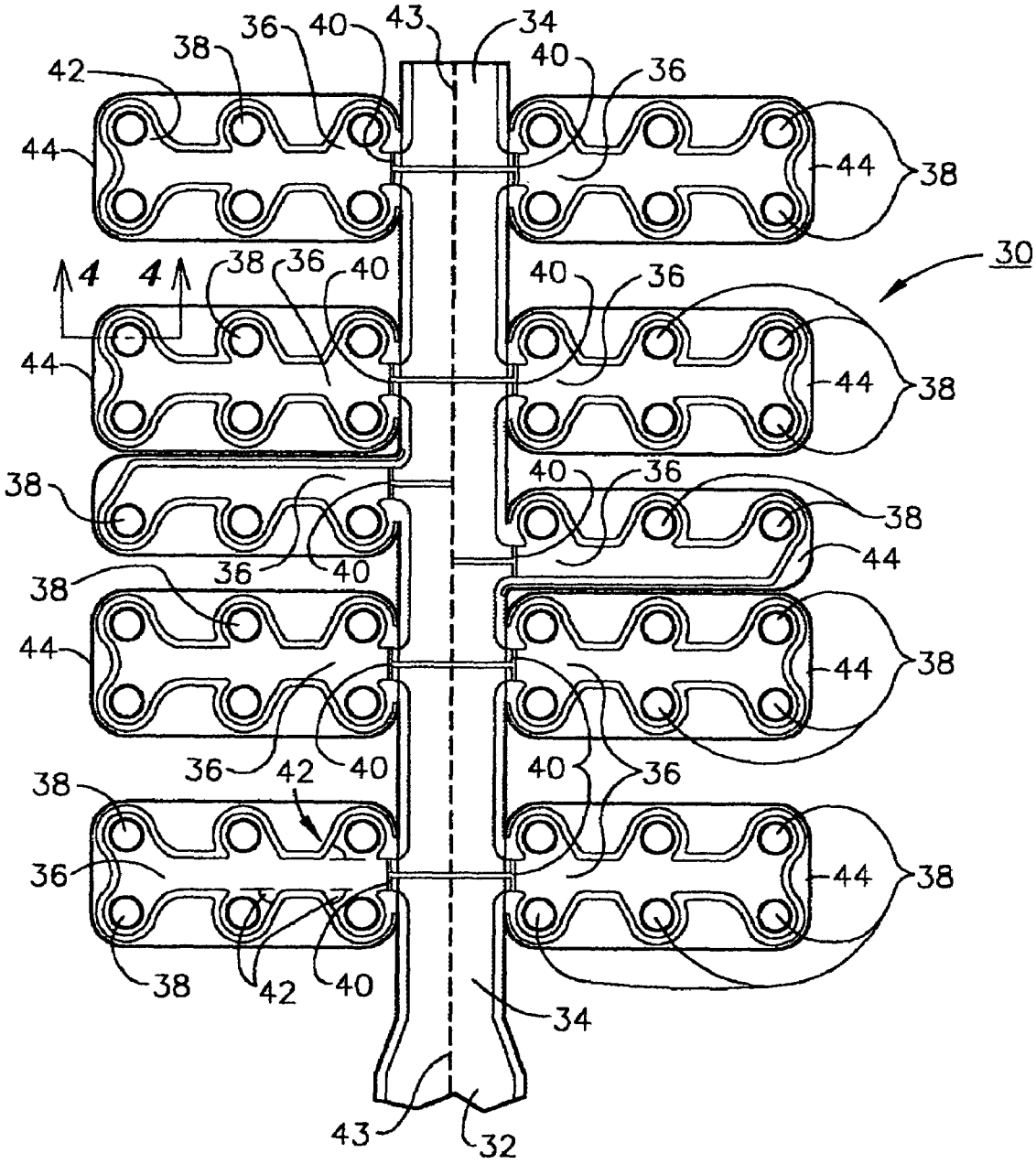
FIG. 2 is a top view of one embodiment of the metal distribution system described in the '119 application.

Referring now to FIG. 2 that presents a top plan view of the metal distribution system described in the '497 patent, there is provided an inlet 32 feeding a single preferably centrally located primary trough 34 having a plurality of relatively short secondary troughs 36 each feeding a plurality of opposing apertures 38 (not all numbered in FIG. 2 for clarity) that contain molds (not show in FIG. 2). Dams 40 are provided at the entry of each of the secondary troughs 36. Dams 40 are controlled by pneumatically or hydraulically operated dam control arm 43 that is remotely operated from an operators station (not shown). In operation, molten metal is flowed through inlet 32 into primary trough 34 where its flow is limited by the presence of dams 40, once primary trough 34 is filled to the appropriate level, dam control arm 43 is activated raising dams 40 allowing metal to flow simultaneously into all or selected secondary troughs 36 and thence into apertures/molds 38. Thus, primary trough 34 and secondary troughs 36 are flowably connected. Because of the angular structure of entry angles 42 as described in greater detail below, molten metal of all relatively the same fill time and temperature rapidly fills apertures/molds 38 simultaneously thereby eliminating the problem of unequal temperature metal in the casting table at different locations, i.e. providing minimum fill time and accompanying minimum temperature loss with maximum velocity to avoid flashing. Through the incorporation of the remotely operated dams 40, the need for the presence of operators on the casting table during the start-up procedure is eliminated.

Figure 4:
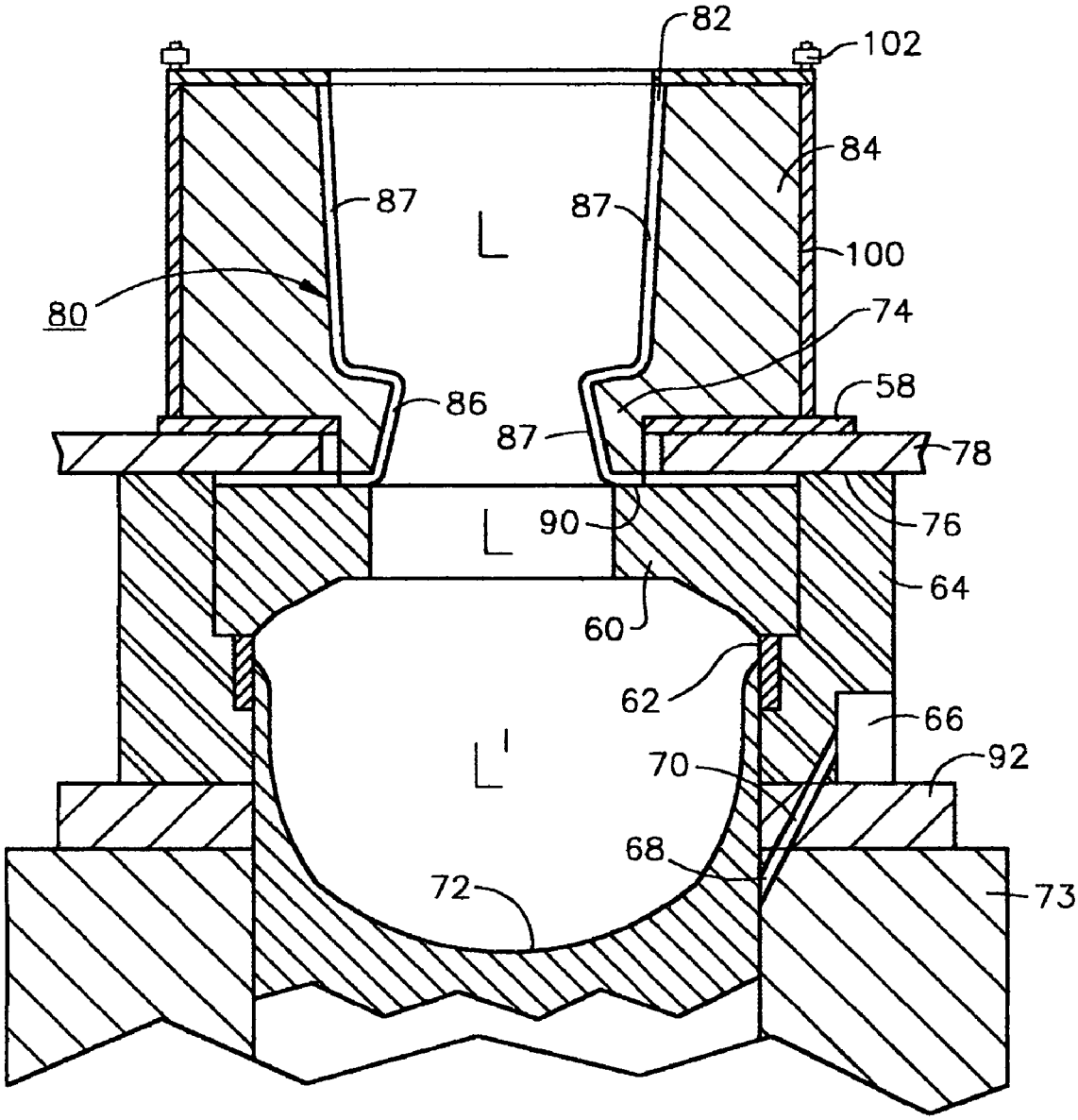
FIG. 4 is a cross sectional view of one embodiment of a mold of the present invention.
Figure 5:
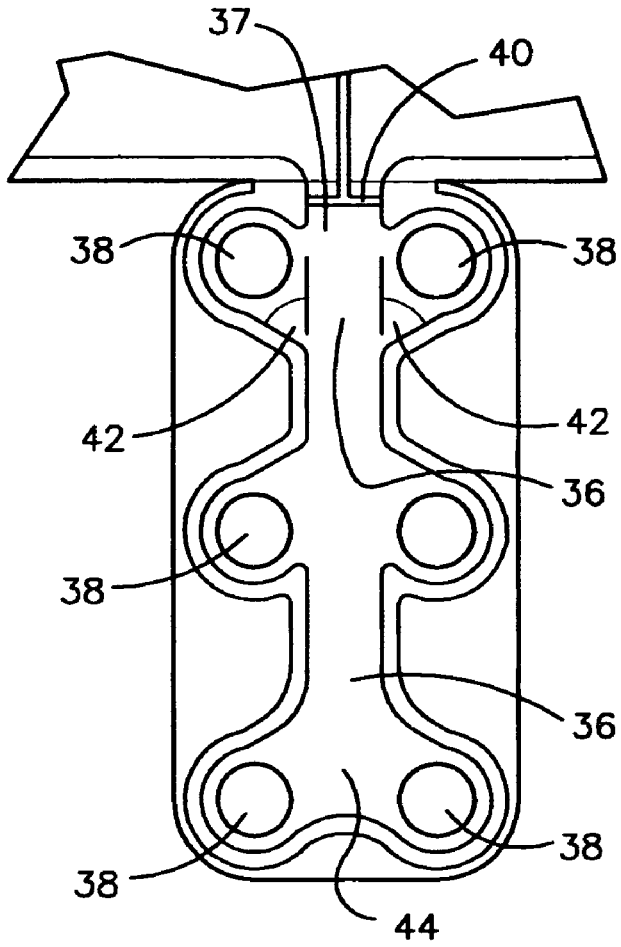
FIG. 5 is a top plan view of a single secondary trough in accordance with the present invention.

Referring now to FIGS. 4 and 5, according to a specifically preferred embodiment of the invention described in the '497 patent, aperture entry angles 42 located at the entry of apertures 38 proximate primary trough 34, i.e. those at the upstream end 37 of secondary troughs 36, are negative and preferably range from about 15 to about 30 degrees and most preferably between about 20 and 25 degrees. The negative orientation of these angles and their particular pitch as specified herein provide for the rapid and uniform fill of apertures 38 downstream thereof toward extremities 44 with a minimum of metal fill time and velocity into apertures 38 thus preventing metal flash and inclusion causing turbulence and providing relative temperature uniformity in the molten metal. Stated differently, filling of secondary troughs 36, because of the angular orientation of entry angles 42 results in secondary troughs 36 filling from the downstream ends 44 toward the upstream ends 37. In operation, as metal enters secondary troughs 36 upon the raising of dams 40 molten metal immediately flows to the outermost extremities or downstream ends 44 of secondary troughs 36 whereupon it quickly fills apertures 38 further downstream of primary trough 34 and then commences to fill secondary troughs 36 "backwards" in the direction of primary trough 34 or the upstream ends of secondary troughs 36. This action provides for the quick and controlled filling of all apertures 38 with a minimum of turbulence and with molten metal of relatively the same temperature to assure a uniform start to the cast with a minimum occurrence of bleedthrough or freeze-in and significant reductions in in head and butt defects that reduce the need for head and butt crop and increase the productivity of the casting operation.

Figure 3:
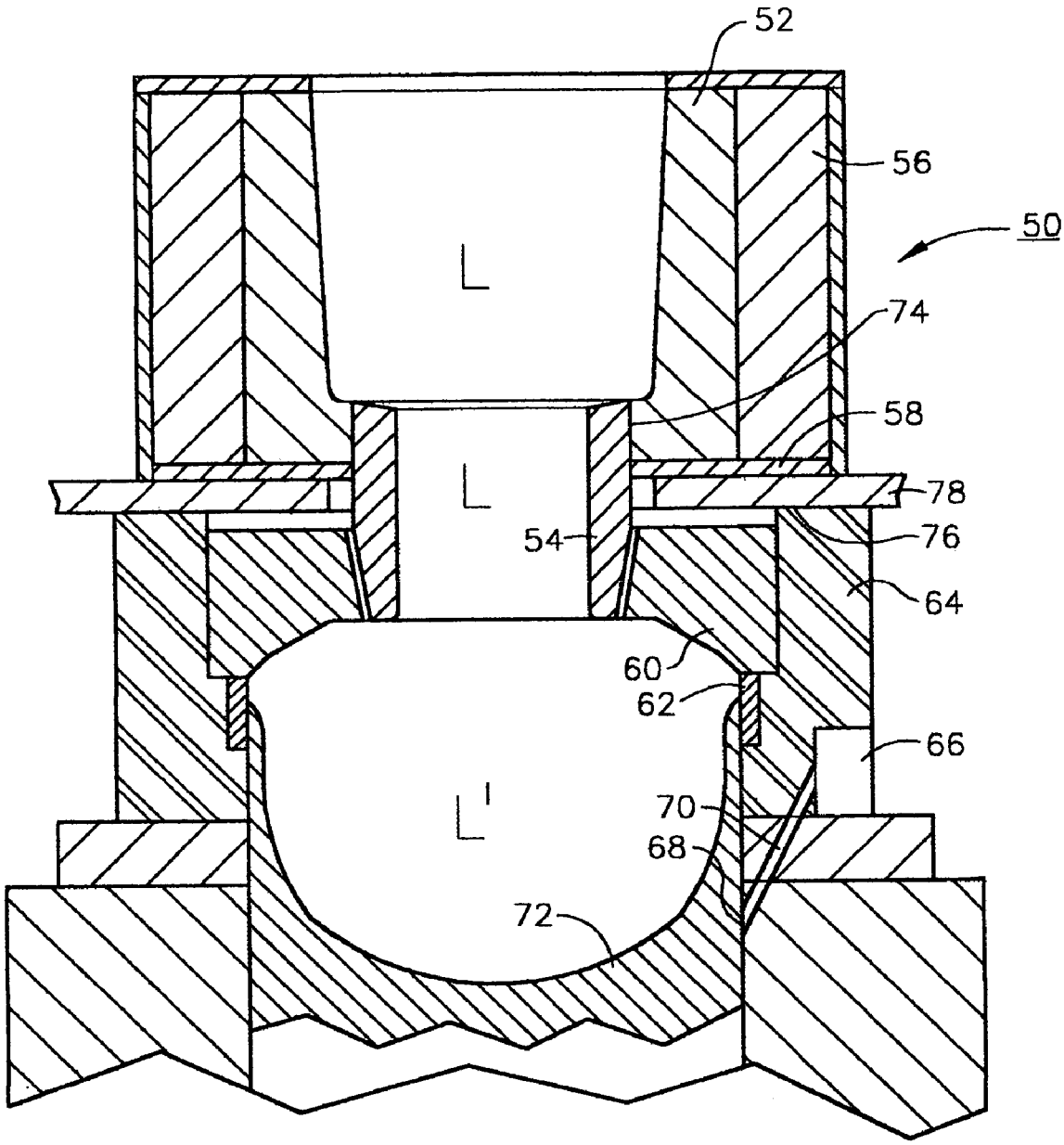
FIG. 3 PRIOR ART
FIG. 3 is a cross-sectional view of a mold of the prior art.

Each of apertures 20 and 38 contains a mold. As shown in FIG. 3, in the prior art, mold 50 comprised a crossfeeder 52, a thimble 54, a blanket of backup insulation 56, a "paper" (mica of the like) or similar gasket 58, a transition plate 60, a mold body 64 and a graphite ring 62. A water reservoir 66 that produced a water spray 68 through the emission of water through spray channel 70 provided cooling of the solidifying metal 72. The letters L and L' in FIG. 3 indicates those areas where molten metal remains liquid as it moves through mold 50 before solidifying at 72. The volume L' is referred to as the "sump".

In such prior art assemblies, thimble 54, crossfeeder 52, back-up insulation 56 and transition plate 60 all represented individual components that were assembled" in situ" so to speak at the casting station or in a fabrication shop before startup of a cast. This clearly involved a significant amount of labor. Additionally, it was not uncommon for vertical joint 74 between thimble 54 and crossfeeder 52 to leak resulting in a bleedthrough of molten metal into joint 76 at gasket 58 between crossfeeder 52 and blanket insulation 56 and casting structure 78. Such leakage not only affected productivity, but could cause a safety issue under certain particularly severe conditions. Additionally, the variability in assembly technique from operator to operator introduced a further element of uncertainty or variability into a casting operation that was already fraught with variables. Thus, a solution had been sought that would significantly reduce the labor intensity of the mold insertion/fabrication operation, reduce any variability in the assembly operation and reduce the potential for leakage at the previously described assembly joints.

Such a solution is shown in FIG. 4 that is a cross-sectional representation along the line 4—4 of FIG. 2. The improved metal handling system 80 described in the '497 patent and shown in FIG. 4 also comprises a crossfeeder 82, back-up insulation 84 and a thimble 86 but all fabricated as a monolith that simply drops into apertures 38 through horizontal engagement with mold table 88 at horizontal joint 90 and transition plate 78 that is part of mold 60 that further engages mold table bottom plate 62 supported on mold member 73. The entire structure is retained in close and tight engagement through the action of a bolt down arrangement through steel upright 100 that includes a nut 102 or other suitable fastening arrangement to bring the entire structure together. A graphite lubricating ring 62 as used in the prior art is incorporated in much the same fashion and for the same purpose as in the prior art. Cooling water sprays and a water reservoir are also preferably incorporated into the mold assembly, as shown in FIG. 4. The foregoing structure has been found to: 1) reduce heat loss through the back-up insulation to a greater degree than the blanket back-up insulation used in the prior art; results in fewer cracked logs at start up; 3) results in fewer cold start related defects such as bleedouts and freeze-ins; and 4) quite obviously increases the ease of assembly, and greatly reduces the labor involved in the mold assembly operation.

What clearly differentiated refractory module 80 of the '497 patent from the prior art is that it comprised a module that combined in a single integral unit, a hot face refractory for crossfeeder 82 and thimble 86, with a peripheral, low density, cold face refractory, back-up insulation 84, thereby eliminating the need to separately insulate behind crossfeeder 82 and thimble 86 or to assemble the individual elements at the casting station or at some remote location. It also eliminated the need for a separate vertical joint (74 in FIG. 3) since thimble 86 was cast into the refractory module 80 providing the formation of a horizontal seal 90 (rather than a vertical seal) directly with the transition plate 78.

The aim of the crossfeeder is mainly to distribute molten metal to the mold while minimizing turbulence and heat losses. The refractory material should be inert vis-avis molten metal such as aluminum, easy to clean and show a low heat storage. Prior art crossfeeders as described in the '497 patent were made of low density refractories that had to be well preheated before casting to avoid cold start-up. Thus, while the structures and materials of the '497 patent provided a useful molten metal handling system, the use of a low density refractory as the inner surface 87 of the integral crossfeeder and thimble posed certain operational issues mainly related to insert life. Depending upon the material and design, maintenance can be quite expensive. The main mode of failure in such devices is crack propagation with time that renders the crossfeeder unusable. Typical life is difficult to determine because it depends on many variables such as: casting technology used, design, casting parameters, maintenance practices, etc., but overall, the useful life os such prior art integral crossfeeder/thimble inserts was less than fully satisfactory.

According to the present invention, two different refractory materials are used to extend the operating life of the crossfeeder and to enhance the casting process itself.

As used herein in connection with interior surface layer 87, the term "thin" is meant to refer to a fiber reinforced fused silica, alumina, zirconia or similar low thermal expansion material layer or plurality of layers of between about 2 and about 19 mm in thickness. According to a preferred embodiment, the "thin" layer is between about 3 and about 6 mm in thickness. Layers of the latter thicknesses provide an optimum minimization of temperature loss along with the suitable wear resistance required for the continuous surface to resist tooling and other damage encountered during operation of such casting equipment.

The material directly in contact with the molten aluminum contacting layer 87 is preferably a dense and hard (damage resistant) refractory material that is at least relatively non-wettable by the molten metal, exhibits high thermal shock resistance and exhibits a low coefficient of thermal expansion. A preferred such material exhibiting these properties is fused silica that exhibits a coefficient of thermal expansion of $0.55\times10^{-6}/°$ C., is very resistant to thermal shock and is not wettable by, for example, molten aluminum. A similar, but somewhat less important desirable characteristic, particularly in molten metal casting operations of the type described above is that the material demonstrate low heat conductivity for purposes of maintaining constant temperatures in the casting operation. In the case of materials used in molten metal casting applications, this is highly desirable so that only minimal heat is extracted from the molten metal during the pouring/casting operation before the molten metal reaches the casting mold and is intentionally cooled and solidified. Fused silica is relatively weak in this property when compared to the Woolastonite based low density refractories described for similar elements in the 'above referenced '497 patent, exhibiting a thermal conductivity of 1.38 $Wm^{-1}K^{-1}$. Thus while highly desirable in certain characteristics, fused silica is relatively weak in thermal conductivity when compared to the prior art materials such as Wollite. As will be demonstrated below, this lack of relatively low thermal conductivity can be overcome through the use of relatively thin layers of fused silica over materials that exhibit very good thermal conductivity resistance such as alumina and silica, and it is this combination of materials/properties that forms the basis of the structures of the present invention. Alumina and zirconia are high density refractories that exhibit physical properties similar to those of fused silica, but exhibit lower thermal conductivities and are similarly useful in the successful practice of the present invention, although fused silica is specifically preferred. Thin skin 87 is then backed up with a layer 84 of a highly insulating relatively low-density refractory material, preferably Wollite, a mineral foam based Wollastonite material. The thin skin layer 87 is used as the mold external/molten metal contacting surface and Wollite insulation 84 is cast around this externally. The two materials constituting thin skin layer 87 and insulating refractory 84, have very similar coefficients of thermal expansion, which avoids delamination and cracking during the heat up and casting cycles. This material combination exhibits a number of desirable characteristics and advantages. Among these are: mechanical strength; crack propagation minimization because of structure; repairability; reduced heat transfer and therefore more consistent molten metal temperature; significantly reduced crossfeeder weight and casting table weight; significantly reduced heat storage and table preheating schedules, and reduced steel shell temperature due to increased insulation factors thereby minimizing steel expansion, joint maintenance and crack propagation. While the materials described above are preferred for use in the devices described and claimed herein, it will be readily apparent the combinations of these materials with each other and with other similar materials such as a mixture comprising 50% fused silica and 50% silicon carbide can be similarly useful and are deemed within the scope of the appended claims. Thus, the use of relatively high density, low thermal expansion and high wear resistance materials for the thin skin layer(s) 87 along with compatibility of these materials with the back-up insulation are the principle drivers in the selection of suitable "skin" materials.

Thus, in the casting insert 80 of the present invention, cylindrical crossfeeder 82 and cylindrical thimble 86 present a continuous, joint free and uninterrupted cylindrical interior surface layer 87 surrounded by an integral peripheral layer of back-up insulation.

Among the preferred back-up insulation materials is a fiber reinforced castable insulating material commercially available from Pyrotek, Inc, 9503 East Montgomery Avenue, Spokane, Wash. 99206 under the tradename "Pyroflow". Pyroflow is a free flowing dry insulating material that exhibits excellent insulating properties, a service temperature of up to 900° C. or 1650° F. and a density of between about 25 and 30 lb/ft$^3$. This material comprises from about 23 to about 28 weight percent aluminum oxide, from about 51 to about 61 weight percent silicon dioxide, from about 0.5 to about 0.6 weight percent crystalline silica, form about 0.8 to about 0.9 weight percent titanium dioxide, from about 3.0 to about 4.0 weight percent iron oxide, from about 5 about 15 weight percent boron oxide, from about 0 to about 5 weight percent calcium fluoride and from about 0 to about 0.5 weight percent of a dust suppressant. Wollite and generally any insulating castable having a density of between about 25 and about 50 lb.cu. ft. will be satisfactory, however Wollite, a mineral foam based wollastonite available from Pyrotek, Inc, Spokane Wash., having a density of between about 25 and about 45 lb/cu-ft and most preferably about 37 lb.cu.ft are also preferred as exhibiting a good balance between thermal conductivity and mechanical properties. In addition to the materials specifically listed above, other moldable insulating materials exhibiting the required properties can also be used. These includes such materials as: Thermbrake 2× commercially available from Stellar Industries Incorporated, 777 Glades Road, Suite 200, Boca Raton, Fla. 33434; Plicast Airlite and Plicast LWI-25 commercially available from RHI Refractories AG, Wienerberger Strasse 11, A-1100, Vienna, Austria; and Castable Insulation #22 commercially available from A.P. Green Industries, Inc., Mexico, Mo. 65265.

The reinforcing fiber for both thin skin layer 87 and back-up insulation 84 is preferably a woven fiberglass material. Such materials are well known in the art. Suitable and preferred such materials include those commercially available from Pyrotek, Inc. under the tradename "Glasweve HT" which can be supplied in pre-sewn shapes that are commonly used for molten metal filtration and diffusion. High silica content cloth (>80%), Nextel® fabric commercially available from the 3M Company, Minneapolis, Minn., basalt based fabrics and carbon based fabrics commercially available from Kaiser Carbon—Carbon Products and other suppliers. Chopped fiberglass or ceramic fibers can also be used in the slurry preparations described below to replace the preferred fiberglass reinforcement. Fiberglass or ceramic paper or felt can also be used as a replacement for fiberglass fabric described above. In the case of fiberglass, silica, carbon, ceramic or other woven fabrics, the openings in the fabric can vary broadly depending upon the operating properties and surface finish required.

Figure 6:
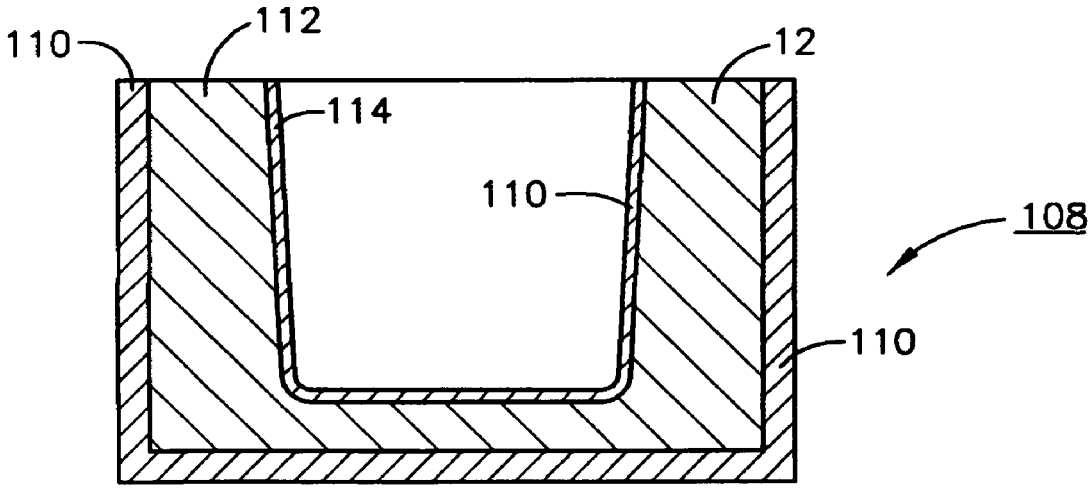
FIG. 6 is a cross-section of a molten metal handling structure in accordance with the present invention.

While the integral molten metal handling structures disclosed herein have been described largely in the context of their use in crossfeeder/mold applications, it will be readily apparent that structures of a similar cross-section could be molded and fabricated for use as trough liners, separate cross feeder and thimble elements as described hereinabove in connection with the discussion of prior art such structures and the like in other applications wherein molten metal is being transported from one location to another. Thus, it is contemplated as within the scope of the appended claims that any integral/monolithic molten metal handling structure comprising a first thin, fiber reinforced relatively high density refractory interior molten metal contacting layer and a fiber reinforced back-up insulation layer, both having relatively the same coefficient of thermal expansion, is within the scope of the appended claims. Such a structure could, for example, be used as the lining for troughs 34 and 36 with the same operational advantages described hereinabove for the use of similar structures for crossfeeder and mold applications. A cross-section of such a structure 108 is shown in FIG. 6 attached hereto. In that Figure a steel trough shell 110 is lined with an integral liner comprising a thin hard refractory molten metal contact layer 112 and castable refractory back-up insulation layer 114.

The following Example will serve provide non-exclusive instructions for the fabrication of suitable molten metal contact materials. The fabrication of the fiber reinforced back-up insulation materials is well known and documented in the literature.

EXAMPLE

Molten Metal Contact Layer Fabrication

Two kilograms of dry fused silica mix, 500 grams of Ludox 40% colloidal silica available from e. I. DuPont DeNemours Corp. and 6 g of 85% technical phosphoric acid are placed in a mixer and blended at low speed under appropriate fume extraction conditions. Once dusting of the previously blended materials has stopped, an additional 400 grams of Ludox is added to the blender and the speed increase to a medium speed. Blending continues until a doughy texture is obtained. An additional 6 g of phosphoric acid is added and additional Ludox added until the consistency of the mixture is a slurry suitable for application to a reinforcing fabric. Alternatively, chopped fibers of fiberglass, ceramic or carbon can be added to obtain the desired slurry. The reinforced slurry is then formed to the desired shape in a mold of one type or another and cured using conventional fabrication techniques as provided by the manufacturer of the slurry materials. It should be noted that a useful slurry can also be made by incorporating approximately equal amounts of woollastonite and colloidal silica into the blend just described. Fabrication of the integral molten metal handling unit is achieved by forming the skin layer(s) into a suitable shape and then using that shape as one face of a mold for the forming of the castable refractory layer. After firing in accordance with the manufacturer's instructions, the two layers become an integral unit.

There have thus been described: a novel metal handling system comprising a monolithic mold insert assembly; and a trough lining system that each individually demonstrate significant operating advantages. Both the mold insert and the molten metal handling system comprise a fiber reinforced molten metal contacting surface layer or layers of a hard refractory material integrally formed with a fiber reinforced castable highly insulating back-up material of relatively the same coefficient of thermal expansion.

As the invention has been described, it will be apparent to those skilled in the art that the same may be varied in many ways without departing form the spirit and scope of the invention. Any and all such modifications are clearly intended to be included within the scope of the appended claims.

What is claimed is:

1. An integral molten metal casting device comprising:

a) a crossfeeder having an interior surface defining a partial cylinder of a first diameter;

b) a generally cylindrical thimble having an interior surface of a second smaller diameter; and c) fiber reinforced back-up insulation;

all formed as a single monolithic structure with the crossfeeder interior surface and the thimble interior surface comprising a thin, continuous, joint free and uninterrupted cylinder insert surface comprised of one or more layers of fiber reinforced high wear resistant, hard and relatively non-wettable refractory material.

2. The integral molten metal casting device of claim 1 wherein the high wear resistant and relatively non-wettable refractory material is fused silica, alumina, zirconia, mixtures of these materials, or mixtures of these materials with others.

3. The integral molten metal casting device of claim 1 wherein the reinforcing fiber comprises fiberglass, high silica content cloth, ceramic fabrics, carbon fabrics, basalt based fabrics, chopped fiberglass, chopped ceramic fibers and chopped carbon fibers.

4. The integral molten metal casting device of claim 1 wherein the back-up insulation comprises a fiber reinforced castable refractory.

5. The integral molten metal casting device of claim 4 wherein the castable refractory has a density of between about 25 and 50 pounds per cubic foot.

6. The integral molten metal casting device of claim 5 wherein the castable refractory comprises Wollastanite.

7. The integral molten metal casting device of claim 1 wherein the layer of fiber reinforced high wear resistant and relatively non-wettable refractory material ranges in thickness from about 2 to about 19 mm.

8. The integral molten metal casting device of claim 6 wherein the layer of fiber reinforced high wear resistant and relatively non-wettable refractory material ranges in thickness from about 3 to about 6 mm.

9. A molten metal handling system comprising:

c) a molten metal contacting layer; and d) fiber reinforced back-up insulation comprising a fiber reinforced castable refractory having a density of between about 25 and 50 pounds per cubic foot;

all formed as a single monolithic structure and wherein the molten metal contacting layer comprises one or more layers of fiber reinforced high wear resistant and relatively non-wettable refractory material.

10. The molten metal handling system of claim 9 wherein the castable refractory comprises Wollastanite.

11. The molten metal handling system of claim 9 wherein the layer of fiber reinforced high wear resistant and relatively non-wettable refractory material ranges in thickness from about 2 to about 19 mm.

12. The molten metal handling system of claim 11 wherein the layer of fiber reinforced high wear resistant and relatively non-wettable refractory material ranges in thickness from about 3 to about 6 mm.

13. An integral molten metal casting device comprising:

a) a crossfeeder having an interior surface defining a partial cylinder of a first diameter;

b) a generally cylindrical thimble having an interior surface of a second smaller diameter; and c) fiber reinforced back-up insulation comprising a castable refractory having a density of between about 25 and 50 pounds per cubic foot; all formed as a single monolithic structure with the crossfeeder interior surface and the thimble interior surface comprising a from about 2 to about 19 mm thick, continuous, joint free and uninterrupted cylinder insert surface comprised of one or more layers of fiberglass, high silica content cloth, ceramic fabric, carbon fabric, basalt based fabric, chopped fiberglass, chopped ceramic fiber and chopped carbon fiber reinforced fused silica, alumina, zirconia, high wear resistant and relatively non-wettable refractory material.

14. A molten metal handling system comprising:

a) a molten metal contacting layer; and b) fiber reinforced back-up insulation comprising a castable refractory having a density of between about 25 and 50 pounds per cubic foot;

all formed as a single monolithic structure and wherein the molten metal contacting layer comprises one or more layers of fiberglass, high silica content cloth, ceramic fabric, carbon fabric, basalt based fabric, chopped fiberglass, chopped ceramic fiber and chopped carbon fiber reinforced high wear resistant and relatively non-wettable refractory material comprising fused silica, alumina, or zirconia from about 2 to about 19 mm thick.

* * * * *